US006360761B1

(12) United States Patent
Zheng

(10) Patent No.: US 6,360,761 B1
(45) **Date of Patent: *Mar. 26, 2002**

(54) COLLAPSIBLE PLAY STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/313,147

(22) Filed: May 17, 1999

Related U.S. Application Data

(63) Continuation-in-part of application No. 09/162,086, filed on Sep. 29, 1998, now abandoned, which is a division of application No. 08/859,876, filed on May 21, 1997, now Pat. No. 5,816,279, which is a division of application No. 08/627,875, filed on Apr. 3, 1996, now Pat. No. 5,664,596, which is a continuation of application No. 08/281,369, filed on Jul. 27, 1994, now Pat. No. 5,560,385, which is a continuation-in-part of application No. 08/024,690, filed on Mar. 1, 1993, now Pat. No. 5,467,794, which is a continuation-in-part of application No. 07/764,784, filed on Sep. 24, 1991, now Pat. No. 5,301,705.

(51) Int. Cl.[7] ..... E04H 15/44

(52) U.S. Cl. ..... 135/126; 135/130; 135/137; 135/97; 135/143; 446/478; 446/487; 220/9.3

(58) Field of Search ..... 135/99, 125–127, 135/130, 143, 115, 117, 148; 446/476, 478, 487, 488, 119; 482/35, 148; 220/9.2, 9.3, 9.4; 52/137

(56) References Cited

U.S. PATENT DOCUMENTS

| | | | | | |
|---|---|---|---|---|---|
| 2,778,560 | A | * | 1/1957 | Pfeiffer | 220/9.2 X |
| 4,815,784 | A | | 3/1989 | Zheng | |
| 5,038,812 | A | | 8/1991 | Norman | |
| 5,385,165 | A | | 1/1995 | Hazinki et al. | |
| 5,439,017 | A | | 8/1995 | Brown | |
| 5,560,385 | A | * | 10/1996 | Zheng | 135/125 |
| 5,592,961 | A | | 1/1997 | Chin | |
| 5,601,105 | A | | 2/1997 | Blen et al. | |
| 5,645,096 | A | | 7/1997 | Hazinski et al. | |
| 5,664,596 | A | * | 9/1997 | Zheng | 135/126 |
| 5,676,168 | A | | 10/1997 | Price | |
| 5,778,915 | A | | 7/1998 | Zheng | |
| 5,800,067 | A | | 9/1998 | Easter | |
| 5,816,954 | A | | 10/1998 | Zheng | |
| 6,109,281 | A | * | 8/2000 | Lowenthal | 135/125 |

* cited by examiner

*Primary Examiner*—Winnie S. Yip
(74) *Attorney, Agent, or Firm*—Raymond Sun

(57) ABSTRACT

Collapsible structures are provided having at least four panels, including a bottom panel, a first panel, a second panel and a third panel. Each panel has a foldable frame member having a folded and an unfolded orientation, with a fabric material covering portions of the frame member to form the panel when the frame member is in the unfolded orientation. The fabric assumes the unfolded orientation of the frame member. Each panel further includes a first side and a second side, with the first side of one panel coupled to the second side of an adjacent panel, and with the bottom panel resting on the surface.

16 Claims, 14 Drawing Sheets

COLLAPSIBLE PLAY STRUCTURES

RELATED CASES

This is a continuation-in-part of Ser. No. 09/162,086, filed Sep. 29, 1998 now abandoned, which is a division of Ser. No. 08/859,876, entitled "Collapsible Play Structures", filed May 21, 1997, now U.S. Pat. No. 5,816,279, which is a division of Ser. No. 08/627,875, entitled "Collapsible Play Structures", filed Apr. 3, 1996, now U.S. Pat. No. 5,664,596, which is a continuation of Ser. No. 08/281,369, entitled "Collapsible Play Structures", filed Jul. 27, 1994, now U.S. Pat. No. 5,560,385, which is a continuation-in-part of Ser. No. 08/024,690, entitled "Collapsible Shade Structure", filed Mar. 1, 1993, now U.S. Pat. No. 5,467,794, which is in turn a continuation-in-part of Ser. No. 07/764,784, entitled "Collapsible Shade Structure", filed Sep. 24, 1991, now U.S. Pat. No. 5,301,705, the entire disclosures of which are incorporated by this reference as though set forth fully herein.

BACKGROUND OF THE INVENTION

1. Field of the Invention

The present invention relates to collapsible structures, and in particular, to collapsible structures which may be provided in a variety of shapes and sizes. The collapsible structures may be twisted and folded to reduce the overall size of the structures to facilitate convenient storage and use.

2. Description of the Prior Art

Collapsible objects have recently become popular with both adults and children. Many of these collapsible objects have a plurality of panels which may be twisted and folded to reduce the overall size of the object to facilitate convenient storage and use. Each panel is comprised of a fabric or material that is supported by a resilient frame member, with the fabric or material spanning a portion of, or entirely across, the area supported by the frame member. The frame member supports the periphery of each panel, and is capable of being twisted and folded to reduce the size of each panel.

Examples of such collapsible objects are shown and described in U.S. Pat. Nos. 5,467,794 (Zheng), 5,560,385 (Zheng) and 5,778,915 (Zheng) in the form of collapsible structures. These structures are currently being enjoyed by many people in many different applications. For example, these structures have been provided in many different shapes and sizes for children's play indoors and outdoors. Smaller versions of these structures have been used as infant nurseries. Even smaller versions of these structures have been used as dollhouses and action figure play houses by toddlers and children. As another example, these structures have been made into tents or outdoor structures that can be used by adults and children for camping or other outdoor purposes. These structures have also been used as beach cabanas. Even animals can enjoy these structures. Some of these structures have been made into shelters that can be used by pets, both indoors and outdoors.

The wide-ranging uses for these collapsible structures can be attributed to the performance, convenience and variety that these structures provide. When fully expanded, these structures are stable and can be used as a true shelter without the fear of collapse. These structures are easily twisted and folded into a compact configuration to allow the user to conveniently store the structures. The light-weight nature of the materials used to make these structures makes it convenient for them to be moved from one location to another. These structures also provide much variety in use and enjoyment. For example, a child can use a structure both indoors and outdoors for different play purposes, yet can use the same structure for camping.

Another example of collapsible objects include collapsible game and play structures, such as those illustrated in U.S. Pat. Nos. 5,722,446 (Zheng) and 5,816,954 (Zheng). These structures provide a multitude of game structures that can be enjoyed by children and adults indoors and outdoors.

SUMMARY OF THE DISCLOSURE

It is an object of the present invention to provide collapsible objects and structures that are different from those mentioned above, and which offer the user different variety of play and use.

In order to accomplish the objects of the present invention, the collapsible structure according to the present invention has at least four panels, including a bottom panel, a first panel, a second panel and a third panel. Each panel has a foldable frame member having a folded and an unfolded orientation, with a fabric material covering portions of the frame member to form the panel when the frame member is in the unfolded orientation. The fabric assumes the unfolded orientation of the frame member. Each panel further includes a first side and a second side, with the first side of one panel coupled to the second side of an adjacent panel, and with the bottom panel resting on the surface.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
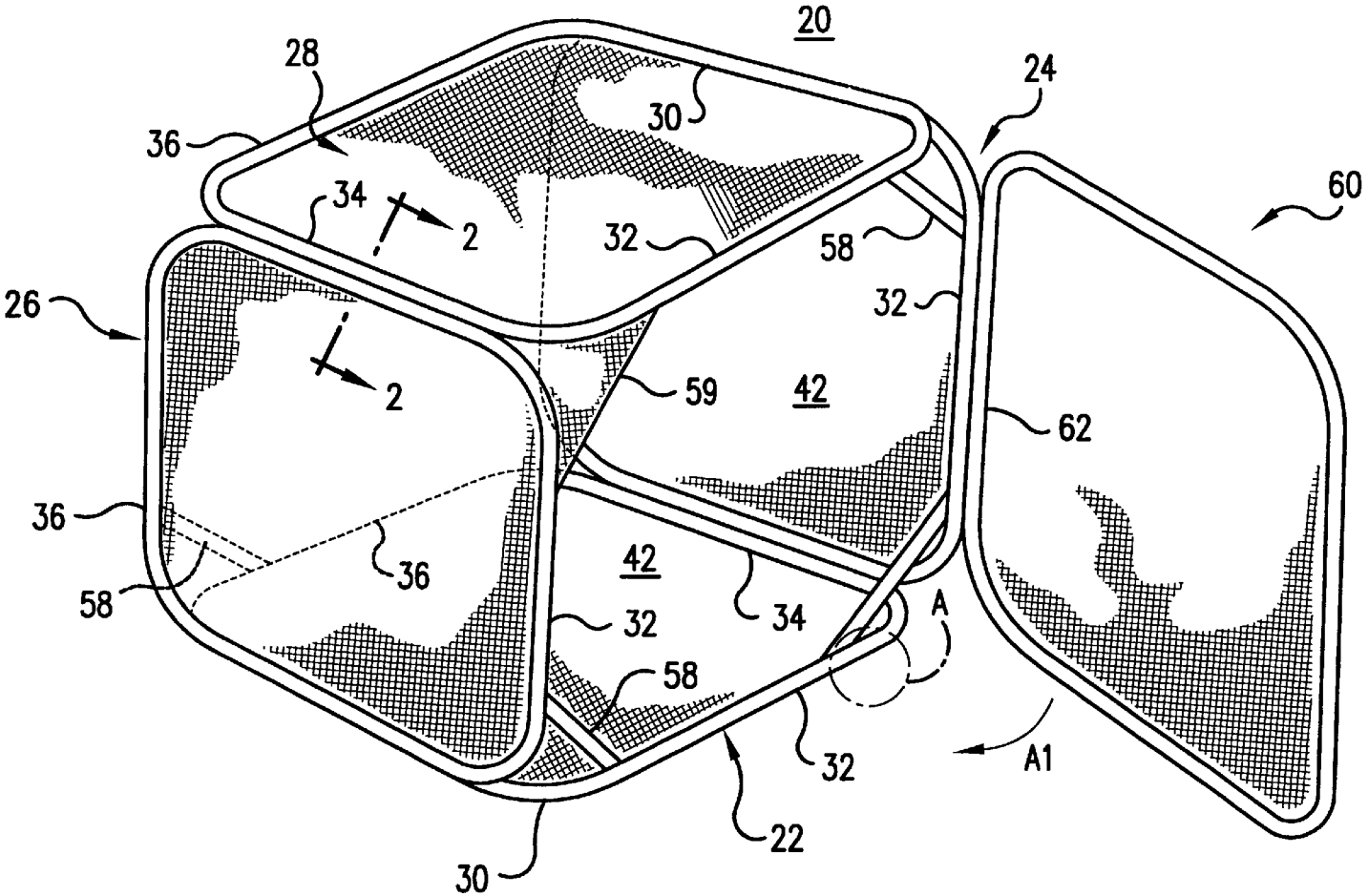
FIG. 1 is a perspective view of a collapsible structure according to one embodiment of the present invention.
Figure 1A:
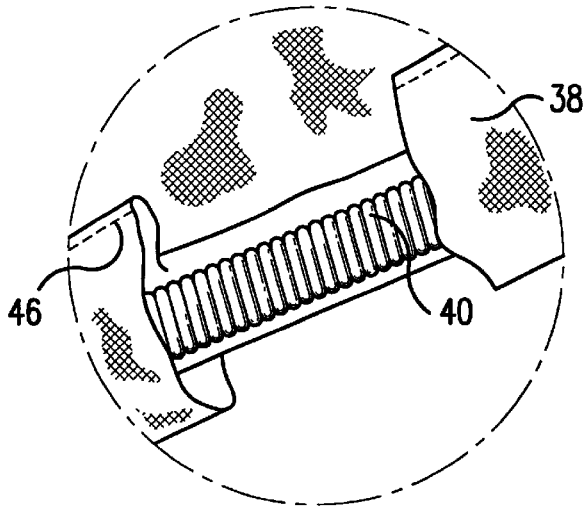
FIG. 1A is a partial cut-away view of the section A of the structure of FIG. 1 illustrating a frame member retained within a sleeve.

FIGS. 1 and 1A illustrate a possible basic component for a collapsible structure according to the present invention which takes the form of a module 20. As explained in greater detail hereinbelow, the collapsible structures according to the present invention can each be comprised of one or more of these modules 20 assembled to create a resulting structure having the desired shape and size.

Referring to FIG. 1, according to a first preferred embodiment of the present invention, each module 20 comprises four panels 22, 24, 26 and 28 connected to each other to encircle an enclosed space. The four panels include a bottom panel 22, two side panels 24, 26, and a top panel 28. Each panel 22, 24, 26 and 28 has four sides, including a first side 30, a second side 32, a third side 34 and a fourth side 36. The first side 30 of each panel is hingedly coupled to the third side 34 of each adjacent panel to form the module 20.

Referring to FIG. 1A, each panel 22, 24, 26 and 28 has a continuous frame retaining sleeve 38 provided along and traversing the four edges of its four sides 30, 32, 34, 36. A continuous frame member 40 is retained or held within each frame retaining sleeve 38 to support each panel 22, 24, 26 and 28. Each sleeve 38 may be formed by folding a piece of fabric and applying a stitching 46. Only one frame member 40 is shown in FIG. 1A; the other frame members are not shown but are the same as frame member 40. The frame members 40 may be merely retained within the respective frame retaining sleeves 38, without being connected thereto. Alternatively, the frame retaining sleeves 38 may be mechanically fastened, stitched, fused, or glued to the frame members 40 to retain them in position.

The continuous frame members 40 may be provided in the form of one continuous loop, or may comprise a strip of material connected at both ends to form a continuous loop. The continuous frame members 40 are preferably formed of flexible coilable steel having a memory, although other materials such as plastics may also be used. The frame members should be made of a material which is relatively strong and yet is flexible to a sufficient degree to allow it to be coiled. Thus, each frame member 40 is capable of assuming two positions or orientations, an open or expanded position such as shown in FIG. 1, or a folded position in which the frame member is collapsed into a size which is much smaller than its open position (see FIG. 3E).

Fabric or sheet material 42 extends across each panel 22, 24, 26 and 28 and is held taut by the respective frame members 40 when in its open position. The fabric 42 for the corresponding panel 22, 24, 26 or 28 is stitched to the sleeve 38. The fabric 42 can extend completely across the panel to entirely cover the space enclosed by the frame member 40, or can extend across selected portions of the space enclosed by the frame member 40. The term fabric is to be given its broadest meaning and should be made from strong, lightweight materials and may include woven fabrics, sheet fabrics or even films and meshed materials. For example, the fabric 42 in FIG. 1 is illustrated as being a meshed material. The fabric should be water-resistant and durable to withstand the wear and tear associated with rough treatment by children.

Figure 2A:
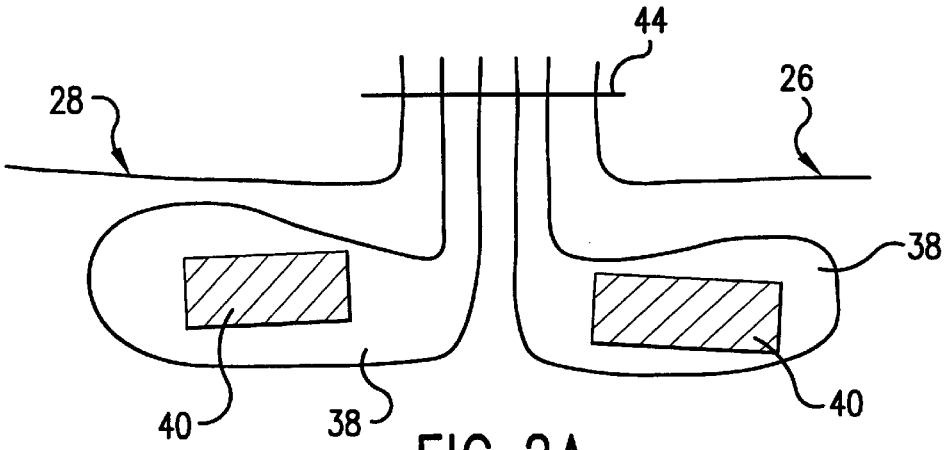
FIG. 2A is a cross-sectional view of a first preferred connection between two adjacent panels of the structure of FIG. 1 taken along line 2—2 thereof.

FIG. 2A illustrates one possible connection for connecting adjacent edges of two panels 26 and 28. The fabric pieces 42 are stitched at their edges to their respective sleeves 38 by a stitching 44. The stitching 44 also acts as a hinge for the panels 26 and 28 to be folded upon each other, as explained below. The connections for the three other pairs of adjacent edges may be identical. Thus, the connections on the first side 30 and the third side 34 of each panel 22, 24, 26 and 28 act as hinge connections for connecting an adjacent panel.

The stitching 44 is essentially the same as stitching 46 illustrated in FIG. 1A, in that both stitchings 44 and 46 also operate to enclose the fabric material to form the sleeve 38. The difference is that stitching 44 extends along the first and third sides 30 and 34 (where a hinge connection is present) and also operates to attach adjacent panels, while stitching 46 merely extends along the second and fourth sides 32 and 36 (where there is no hinge connection).

Figure 2B:
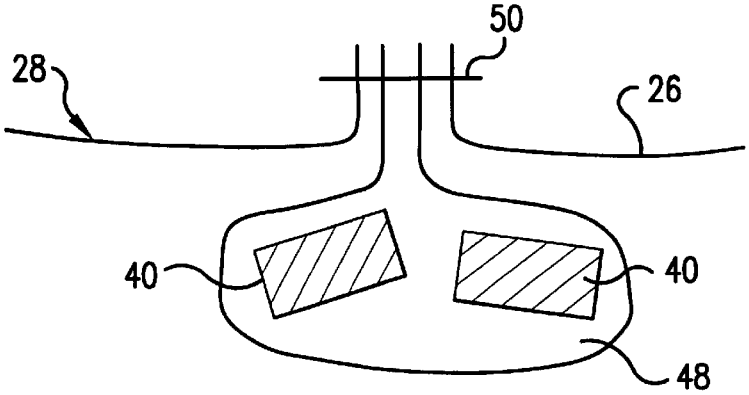
FIG. 2B is a cross-sectional view of a second preferred connection between two adjacent panels of the structure of FIG. 1 taken along line 2—2 thereof.

FIG. 2B illustrates a second possible connection for connecting adjacent edges of two panels 26 and 28. The frame retaining sleeves 38 at the first side 30 of panel 26 and the third side 34 of panel 28 converge at, or are connected to, one sleeve portion which interconnects panels 26 and 28 to form a singular frame retaining sleeve 48 which retains the frame members 38 for panels 26, 28. Sleeve 48 may be formed by providing a tubular fabric, or by folding a piece of fabric, and applying a stitching 50 to its edges to connect the sleeve 48 to the fabric 42 for panels 26, 28. Stitching 50 also acts as a hinge for the panels 26, 28. The connections for the three other pairs of adjacent edges may be identical.

The module 20 can be deployed with the bottom panel 22 resting on the floor or other surface, and with the side panels 24, 26 functioning as side walls. When deployed in this manner, two side openings are defined: a first side opening that is defined by the second side 32 of the panels 22, 24, 26, 28, and a second side opening that is defined by the fourth side 36 of the panels 22, 24, 26, 28.

Figure 4:
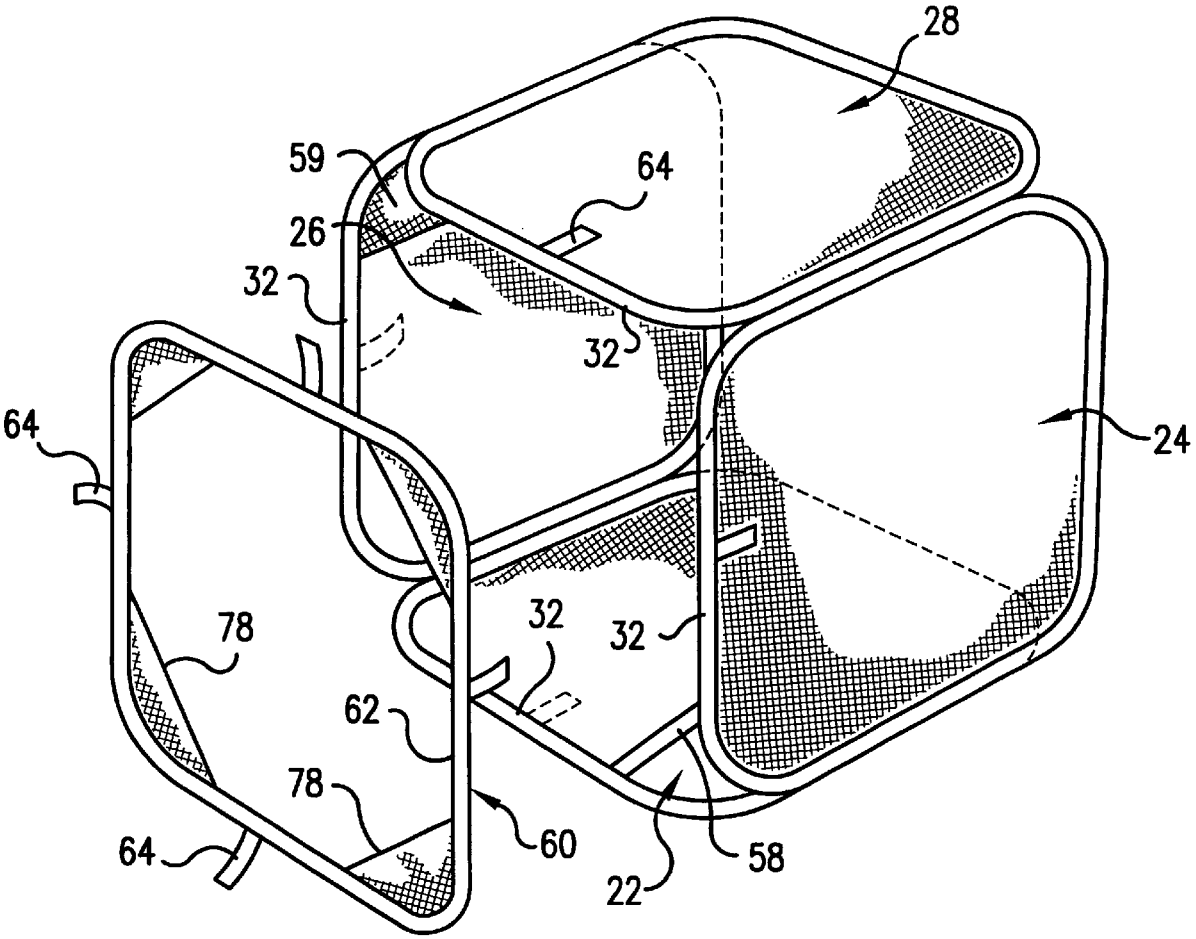
FIGS. 4–6 illustrate modifications that can be made to the structure of FIG. 1.

As shown in FIG. 1, an optional side panel 60 can be provided to cover the first side opening. The side panel 60 can have the same construction as side panels 24, 26, and can have a third side 62 hingedly coupled to the second side 32 of the side panel 24 using either of the techniques illustrated in FIGS. 2A or 2B. Alternatively, as shown in FIG. 4, the side panel 60 can be removably coupled to the second side 32 of the panels 22, 24, 26, 28 (i.e., the first side opening) by utilizing one or more detachable connectors or removable attachment mechanisms 64 (referred to herein as "attachment mechanisms"), such as opposing Velcro pads, hooks, ties or similar mechanisms. These attachment mechanisms 64 can even be provided on the panels 22, 24, 26, 28 (as shown in FIG. 4) to engage the corresponding attachment mechanisms 64 on the side panel 60. Any number of the sides of the panel 60 can be coupled to the second sides 32 of the panels 22, 24, 26, 28 in the module 20. However, if only one side (e.g., 62 as shown in FIG. 1) of the side panel 60 is coupled to the second side 32 of one of the panels 22, 24, 26, 28, the side panel 60 can be used as a door or end panel that can be pivoted about the hinge connection between sides 32 and 62.

The panel 60 can be provided as a support mechanism to support the module 20 in the upstanding configuration shown in FIG. 1. Therefore, it is possible to couple as many sides of the panel 60 to the second side 32 of as many different panels 22, 24, 26, 28 as desired, some in either a permanent manner (i.e., using the techniques shown in FIGS. 2A or 2B) or in a removable manner (i.e., using removable attachment mechanisms 64). For example, the panel 60 can have different sides coupled to the second side 32 of all four panels 22, 24, 26, 28 to provide an end wall for supporting the four panels 22, 24, 26, 28 in the upstanding configuration.

It is also possible to provide support mechanisms other than the panel 60 for supporting the module 20 in the upstanding configuration shown in FIG. 1. For example, straps 58 can be tied between the second sides 32 of adjacent panels, or between the fourth sides 36 of adjacent panels. These straps 58 help to maintain the generally perpendicular orientation between adjacent panels, since the straps 58 can be provided at selected lengths and at selected positions along the second sides 32, for example, so that two adjacent panels cannot be pivoted so that the angle between adjacent panels extends beyond 90 degrees. The straps 58 can have opposing ends that are stitched, or removably attached (e.g., by a removable attachment mechanism) to the sides 32 or 36 of the panels.

As a further alternative to the panel 60 and the straps 58, a fabric corner piece 59 can be attached to either the second sides 32 or the fourth sides 36 of adjacent panels for supporting the module 20 in the upstanding configuration shown in FIG. 1. Other alternative support mechanisms can be possible, with the common feature for such support mechanisms being that they function to couple two or more sides of adjacent panels to limit the extend to which adjacent panels can pivot.

Figure 3A:
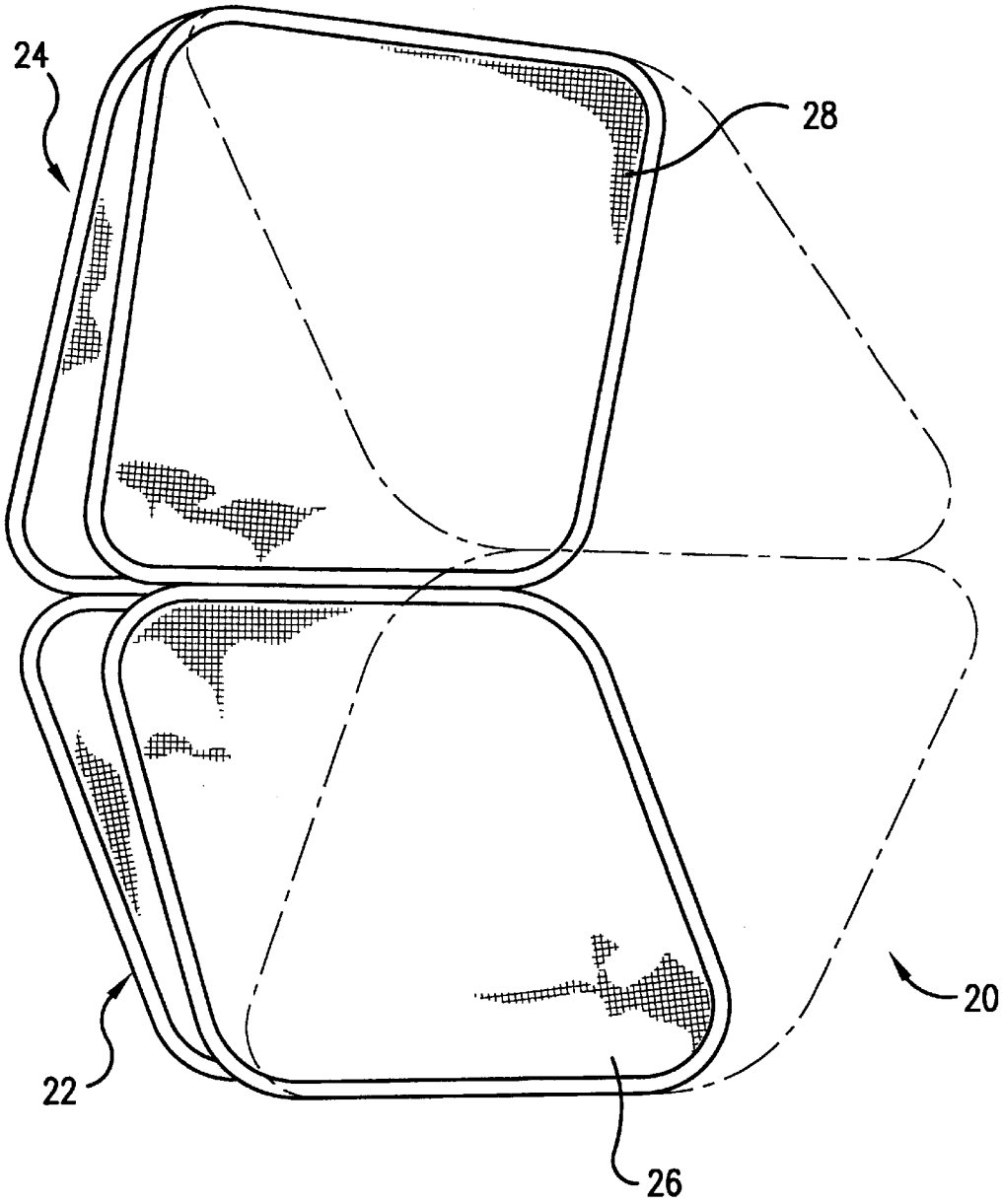
FIGS. 3(A) through 3(E) illustrate how the collapsible structure of FIG. 1 may be twisted and folded for compact storage.
Figure 3B:
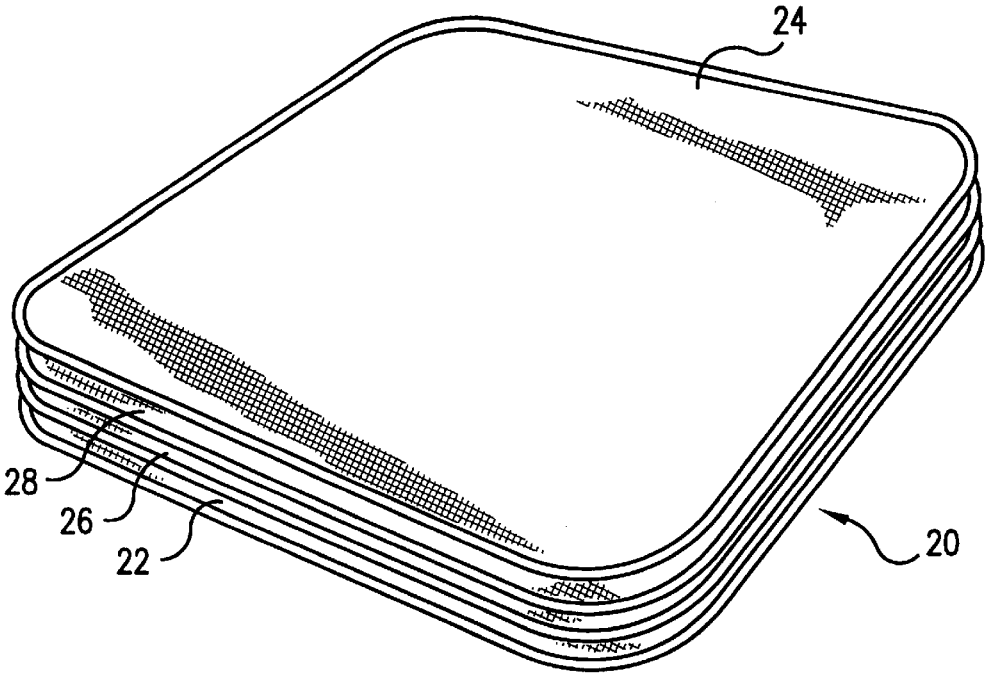
Figure 3C:
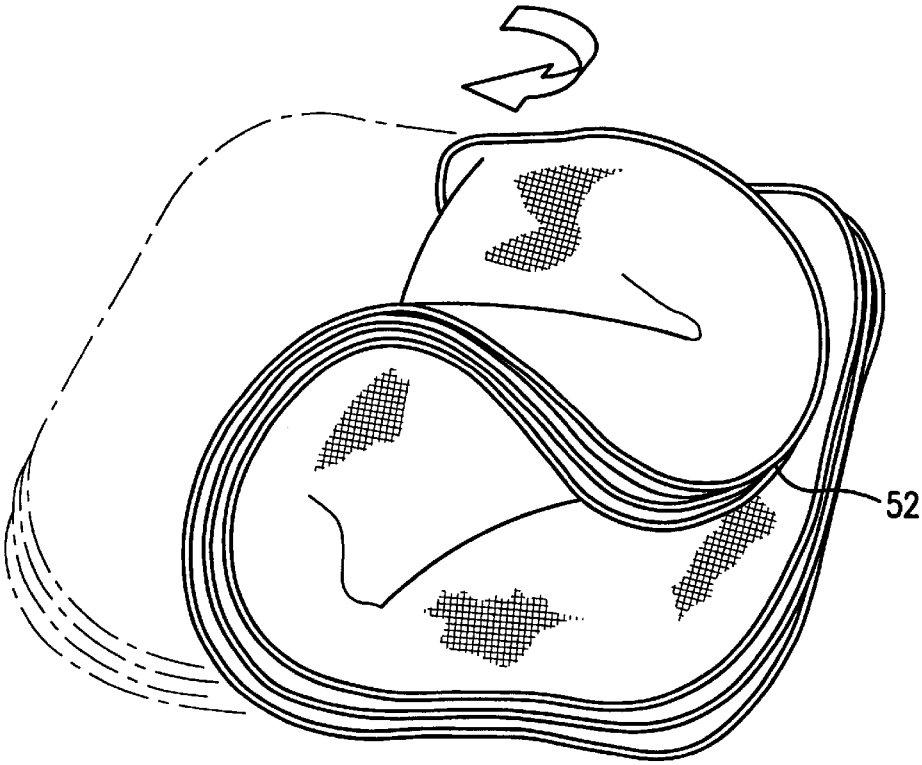
Figure 3D:
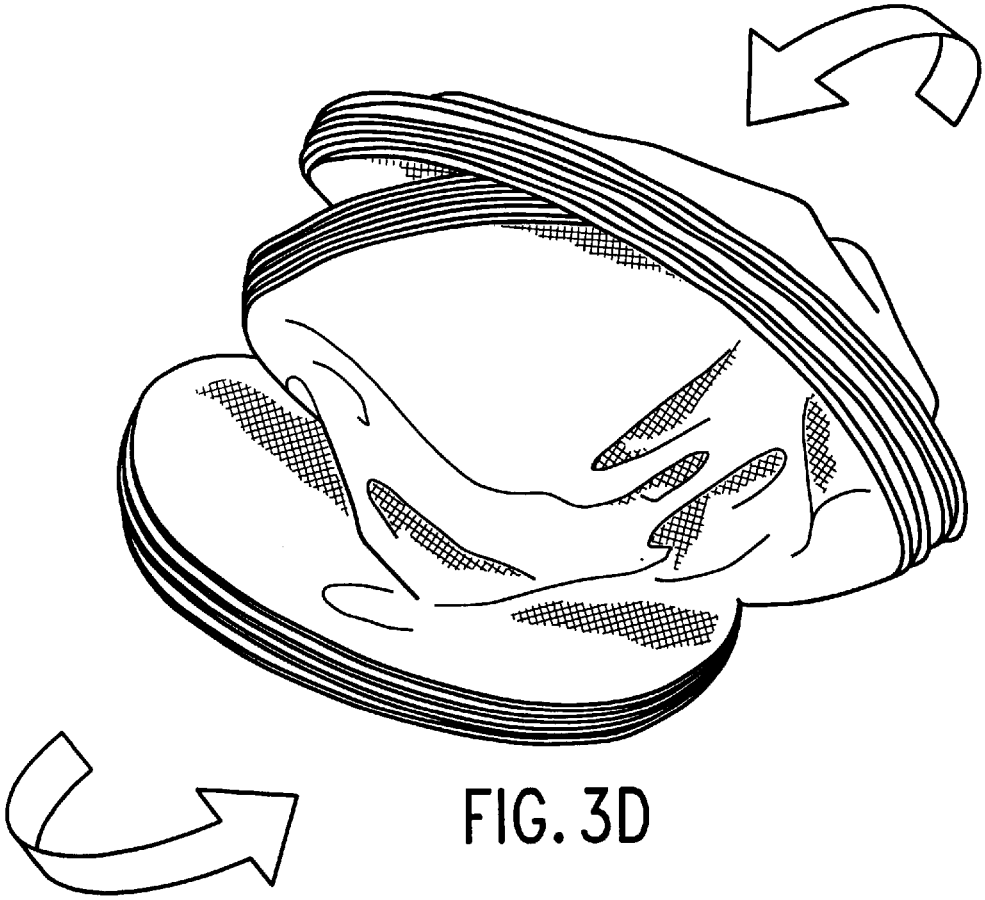
Figure 3E:
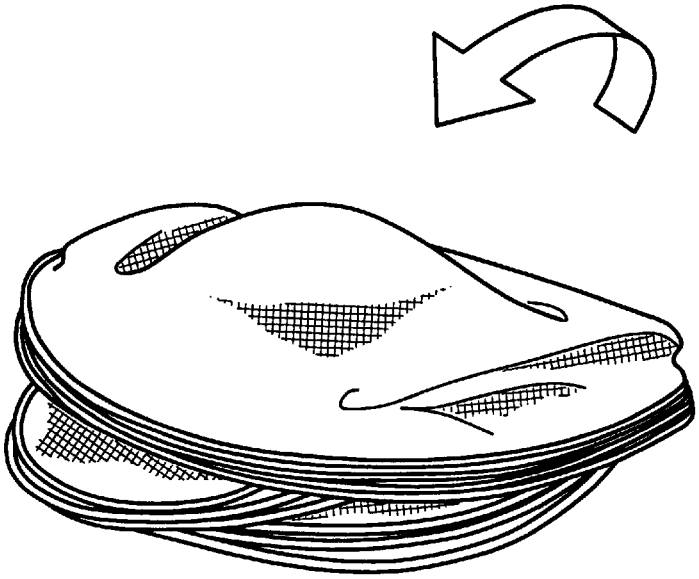

FIGS. 3A through 3E describe the various steps for folding and collapsing the structure or module 20 of FIG. 1 for S storage. If panel 60 is removable, it can be first removed. Then, as shown in FIG. 3A, the first step consists of pushing in panels 26 and 28 about the hinged connections such they collapse against panels 22 and 24, respectively. Then, in the second step shown in FIG. 3B, two panels 24 and 28 are folded about the hinged connections so as to be collapsed upon the other two panels 22 and 26 to create a stack of four panels 24, 28, 26, 22 (in this order). The stack of panels is then twisted and folded to collapse the frame members and panels into a smaller shape. In the third step shown in FIG. 3C, the opposite border 52 of the combined stack of panels is folded in upon the previous fold to further collapse the frame members with the panels. As shown in FIG. 3D, the fourth step is to continue the collapsing so that the initial size of the stack of panels is reduced. FIG. 3E shows the fifth step with the frame members and panels collapsed on each other to provide for a small essentially compact configuration having a plurality of concentric frame members and layers of the panels so that the collapsed module 20 has a size which is smaller than the initial size of the panels.

The optional panel 60, if removable, can be placed on top of the stack of four panels 24, 28, 26, 22 in FIG. 3B, and twisted and folded together as a stack of five panels 60, 24, 28, 26, 22. If the optional panel 60 is stitched to the module 20, then it can be folded about its hinged connection to its adjacent panel 22, 24, 26 or 28 (e.g., folded against panel 24 for the embodiment of FIG. 1 in the direction of arrow A1), and then twisted and folded together as a stack of five panels 60, 24, 28, 26, 22.

To re-open the module 20 to its expanded configuration, the combined stack of panels is unfolded. The memory (i.e., spring-load) of the frame members will cause the frame members to uncoil on their own and to quickly expand the panels to their expanded configuration shown in FIG. 3B. The same principle can be applied to re-open all the other embodiments of the present invention.

Figure 5:
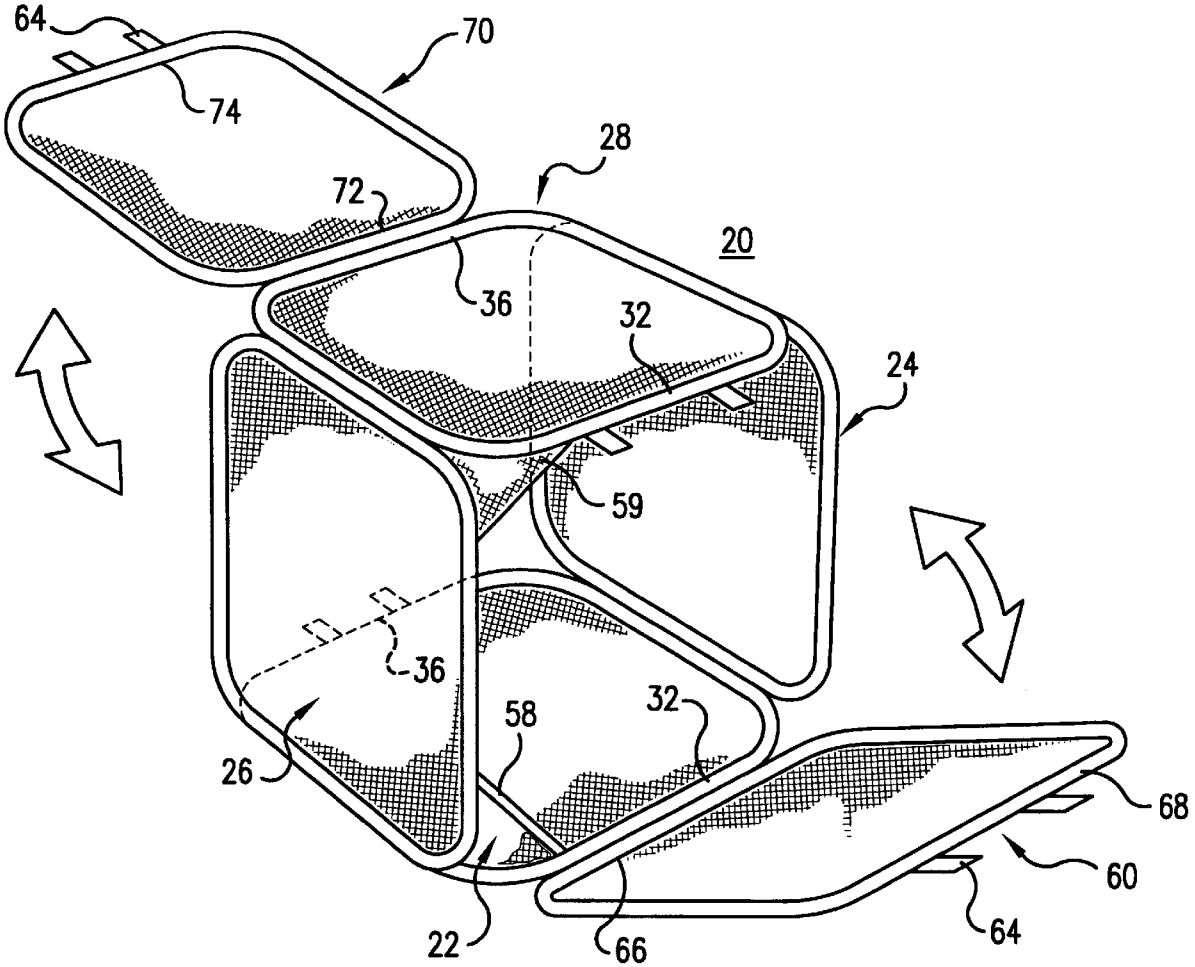

FIG. 5 illustrates a possible modification to the modules 20 shown in FIGS. 1 and 4. Here, the side panel 60 is illustrated as having its bottom side 66 hingedly coupled to second side 32 of bottom panel 22. Attachment mechanisms 64 can be provided on the top side 68 of side panel 60 for securing the top side 68 to second side 32 of top panel 28. In addition, another side panel 70 can be provided to cover the second side opening of the module 20. Side panel 70 has its top side 72 hingedly coupled to fourth side 36 of top panel 28, and attachment mechanisms 64 can be provided on the bottom side 74 of the side panel 70 for securing its bottom side 68 to fourth side 36 of bottom panel 22. The side panels 60 and 70 can be used to support the module 20 in the upstanding configuration. The configuration shown in FIG. 5 can be folded and collapsed according to the principles illustrated in FIGS. 3A–3E.

While the module 20 of FIG. 1 is shown and described as having four side panels, each having four sides, it will be appreciated that a module may be made of any number of panels, each having any number of sides, without departing from the spirit and scope of the present invention. For example, each module may have two or more panels, and each panel may have three or more sides. Thus, the module of the present invention may take a variety of external shapes. However, each panel of the module, regardless of its shape, is supported by at least one continuous frame member.

Figure 6:
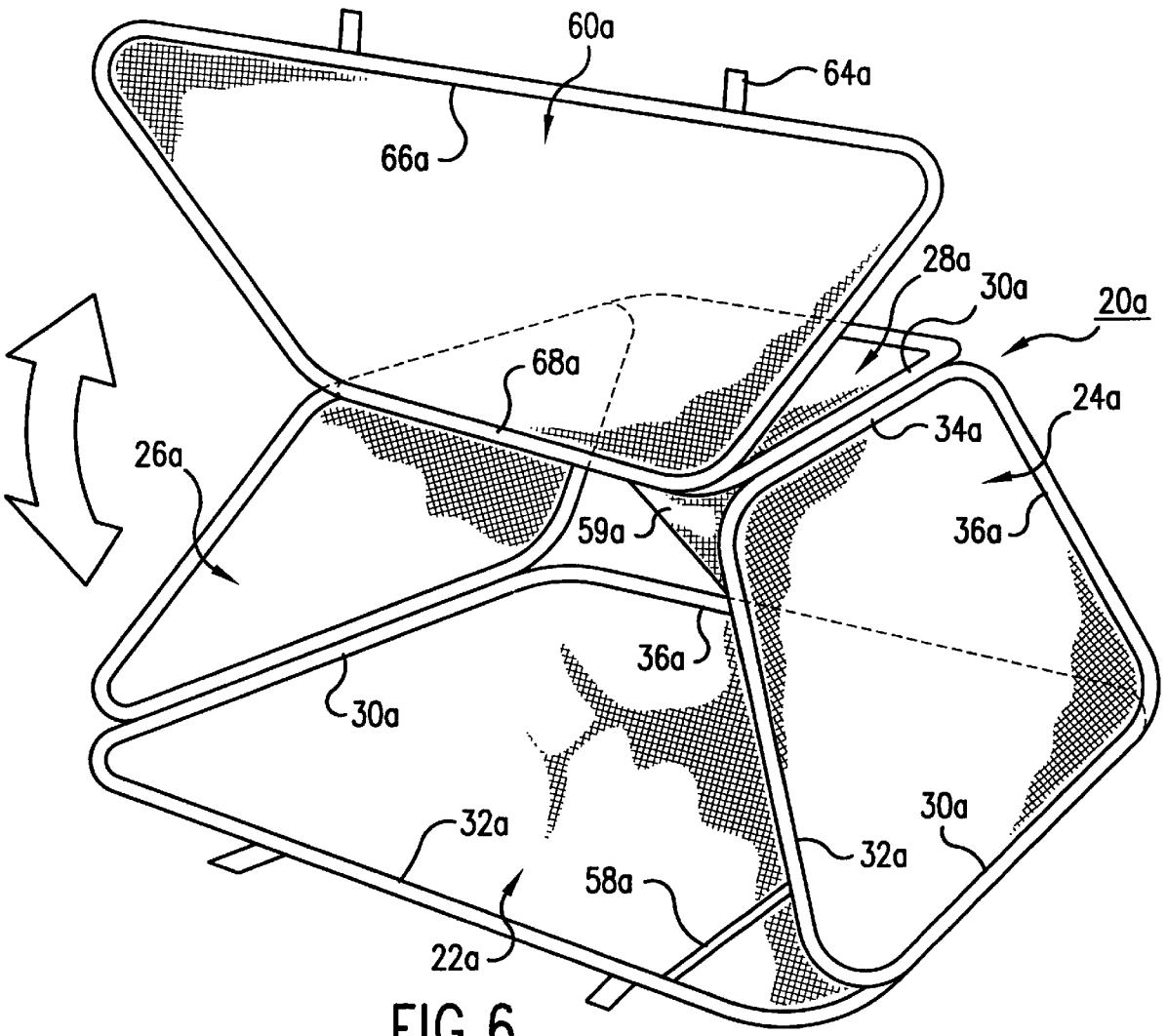

One example of modules having panels with different shapes is shown in FIG. 6, which illustrates a module 20*a* containing modifications to the module 20 of FIG. 1. The elements of the module 20*a* that are the same as the elements of the module 20 are provided with the same numeral designations except that an "a" has been added to the numeral designations in FIG. 6. In particular, the panels 22*a*, 24*a*, 26*a*, 28*a*, 60*a* are the same as panels 22, 24, 26, 28, 60 except that the bottom panel 22*a* is larger than the top panel 28*a*. In addition, the sides 32*a* and 36*a* of the side panels 24*a*, 26*a* are angled upwardly so that (1) the bottom side 30*a* of side panel 24*a* and bottom side 34*a* of side panel 26*a* have the same length as the sides 34*a* and 30*a*, respectively, of the bottom panel 22*a*, and (2) the top side 34*a* of side panel 24*a* and top side 30*a* of side panel 26*a* have the same length as the sides 30*a* and 34*a*, respectively, of the top panel 28*a*. Side panel 60*a* has its top side 68*a* hingedly coupled to second side 32*a* of the top panel 28*a*, and attachment mechanisms 64*a* can be provided on the bottom side 66*a* of the side panel 60*a* for securing its bottom side 66*a* to the second side 32*a* of the bottom panel 22*a*. The configuration shown in FIG. 6 can be folded and collapsed according to the principles illustrated in FIGS. 3A–3E. Thus, the module 20*a* defines a dome-like structure having a wider base.

Figure 7:
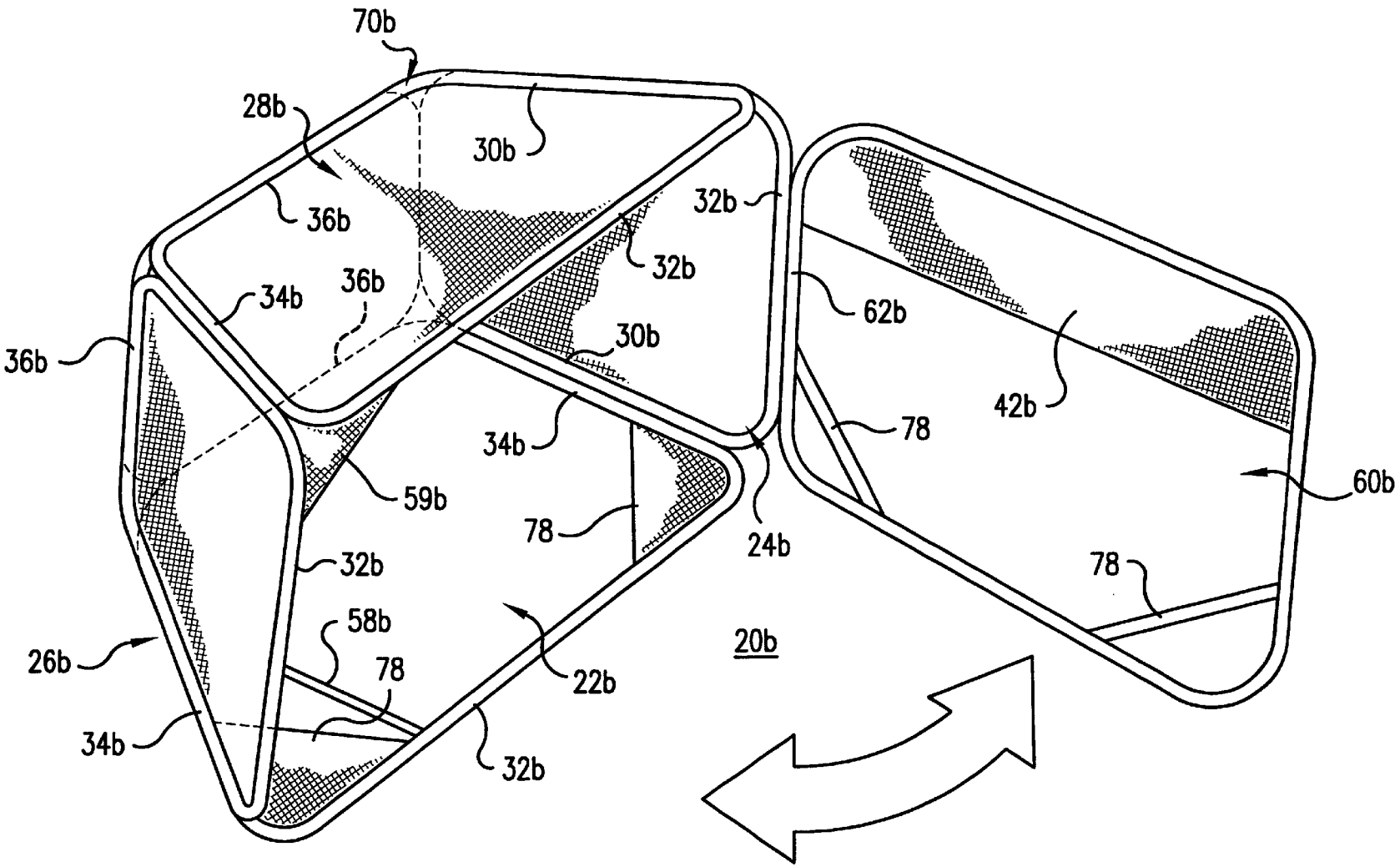
FIG. 7 is a perspective view of a collapsible structure according to another embodiment of the present invention.

As another non-limiting example, FIG. 7 illustrates a module 20*b* containing modifications to the modules 20 and 20*a*. The elements of the module 20*b* that are the same as the elements of the module 20 are provided with the same numeral designations except that a "b" has been added to the numeral designations in FIG. 7. In particular, the panels 22*b*, 24*b*, 26*b*, 28*b*, 60*b* are the same as panels 22, 24, 26, 28, 60 except that the second side 32*b* of each panel 22*b*, 24*b*, 26*b*, 28*b* is longer than the fourth side 36*b* of each panel, and the first side 30*b* and third side 34*b* of each panel 22*b*, 24*b*, 26*b*, 28*b* are angled to facilitate the differences in length between the second and fourth sides 32*b*, 36*b*, respectively. Side panel 60*b* has its side 62*b* hingedly coupled to second side 32*b* of panel 24*b*, like in FIG. 1. The configuration shown in FIG. 7 can be folded and collapsed according to the principles illustrated in FIGS. 3A–3E. Thus, the module 20*b* defines a structure having a wider opening or door (e.g., embodied in the form of panel 60*b*) that narrows inwardly. A panel 70*b* that is smaller than panel 60*b* can be coupled to the fourth side 36*b* of one or more panels 22*b*, 24*b*, 26*b*, 28*b* using any of the coupling techniques illustrated above. The panel 70*b* can be used as another door, or as an end wall for the module 20*b*, or to provide further support to the module 20*b*.

Module 20*b* in FIG. 7 illustrates other possible alternatives and modifications. For example, the fabric 42*b* of panel 60*b* only extends along a portion (e.g., the top half) of the panel 60*b*. At the bottom corners of panel 60*b* are provided straps or corner pieces 78 that have opposing ends attached (e.g., by stitching) to adjacent sides of the panel 60*b*. The straps or corner pieces 78 operate to define the configuration of the panel 60*b* at these corners (i.e., to define the generally right-angled corners in panel 60*b*). Such straps or corner pieces 78 can be utilized in lieu of fabric pieces 42 for any of the panels of the present invention. For example, corner pieces 78 of fabric are also provided for bottom panel 22*b*, and for panel 60 in FIG. 4. The corners defined by these corner pieces 78 can have any angle (including a right angle or 90 degrees) but the angle depends on the configuration of the rest of the panel and the number of corner pieces 78 for that panel. For example, the provision of three corner pieces 78 without any fabric 42 will define a triangular panel, the provision of four corner pieces 78 without any fabric 42 will define a generally square or rectangular panel, the provision of five corner pieces 78 without any fabric 42 will define a generally polygonal or five-sided panel, and so on. Each of these panel configurations (i.e., triangular, square, polygonal) will have corners that have different angles.

Figure 8:
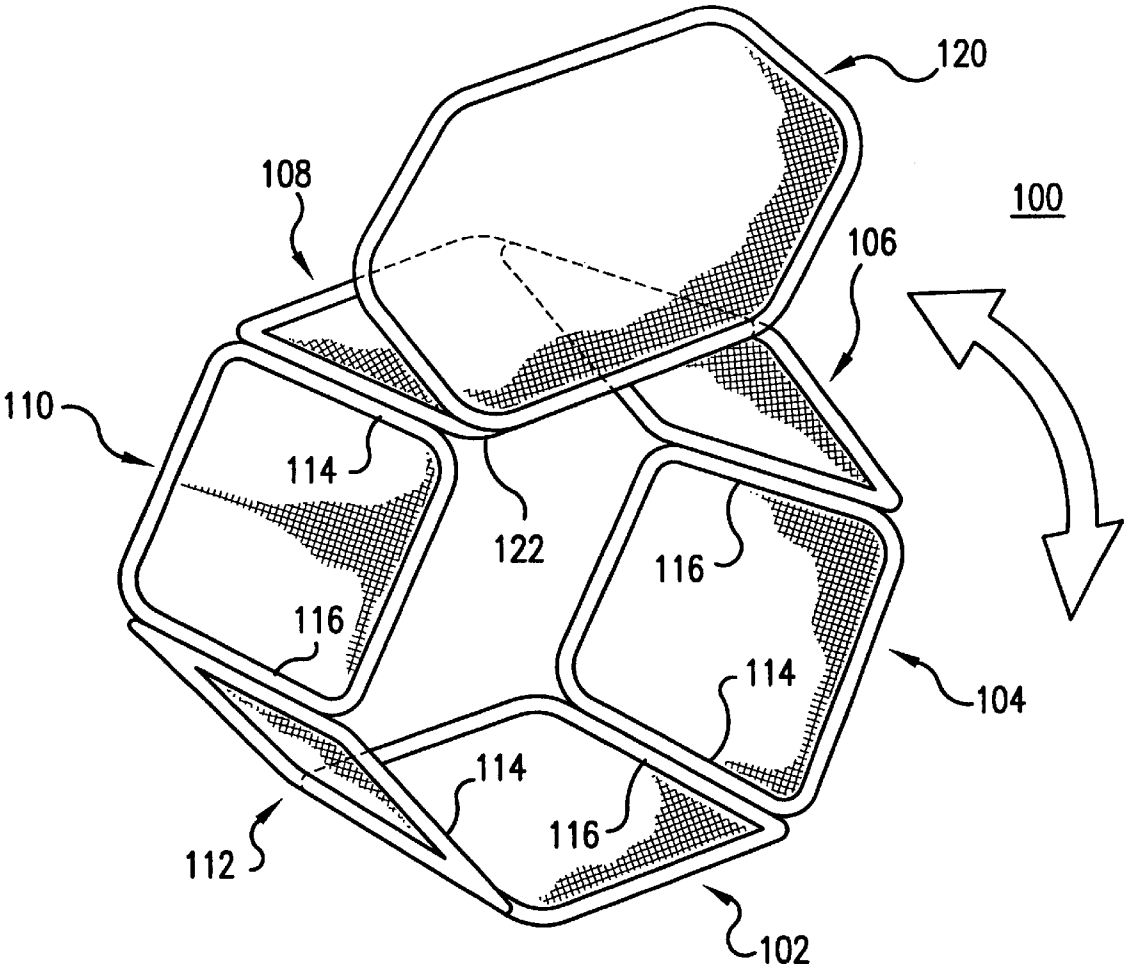
FIG. 8 is a perspective view of a collapsible structure according to yet another embodiment of the present invention.

To further illustrate the flexibility and variety of the principles of the present invention, FIG. 8 illustrates a structure 100 having six panels 102, 104, 106, 108, 110 and 112, each panel having the same construction as the panels 22, 24, 26, 28 in FIG. 1. As with module 20, the first side 114 of each panel is hingedly coupled to the third side 116 of each adjacent panel to form the module 100. A side panel 120 having six sides (one for each panel of the structure 100) may be attached to a second side 122 of the top panel 108 by either a hinged connection such as those illustrated in FIGS. 2A or 2B, or by a removable attachment mechanism. One or more of the other sides of the panel 120 can also be coupled (either through a hinged or removable connection) to the second side 122 of one or more of the other panels 102, 104, 106, 108, 110, 112. Thus, the structure 100 essentially consists of an assembly of six panels that are arranged in a circular orientation. The panel 120 operates to hold the structure 100 in the upstanding configuration.

The structure 100 can be folded and collapsed by first folding panels 108, 110, 112 on top of panels 106, 104, 102, respectively. The panels are then folded to create a stack of six panels that can be folded and collapsed according to the principles illustrated in FIGS. 3B–3E.

Figure 9:
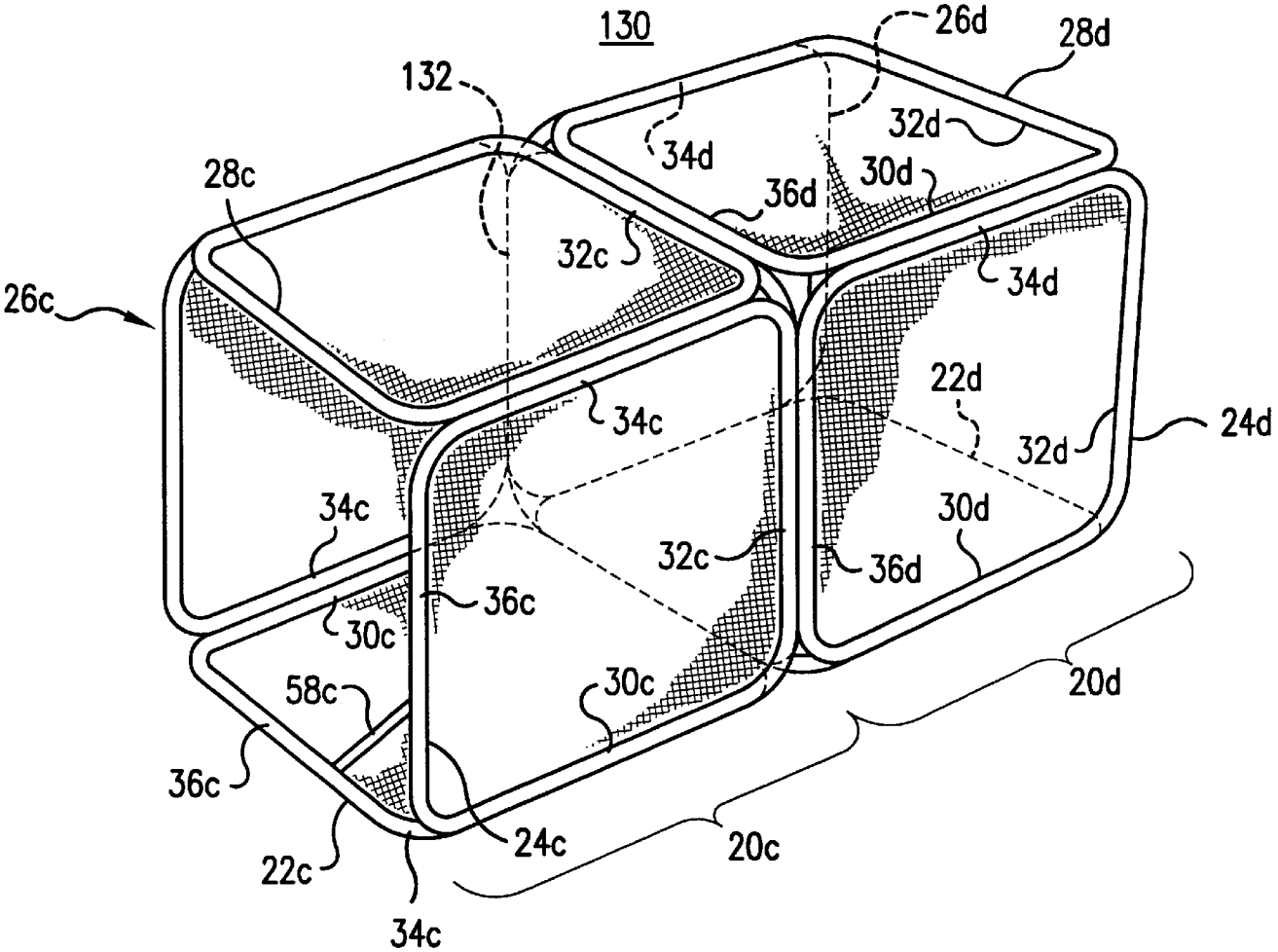
FIG. 9 is a perspective view of a collapsible structure according to a further embodiment of the present invention.
Figure 10:
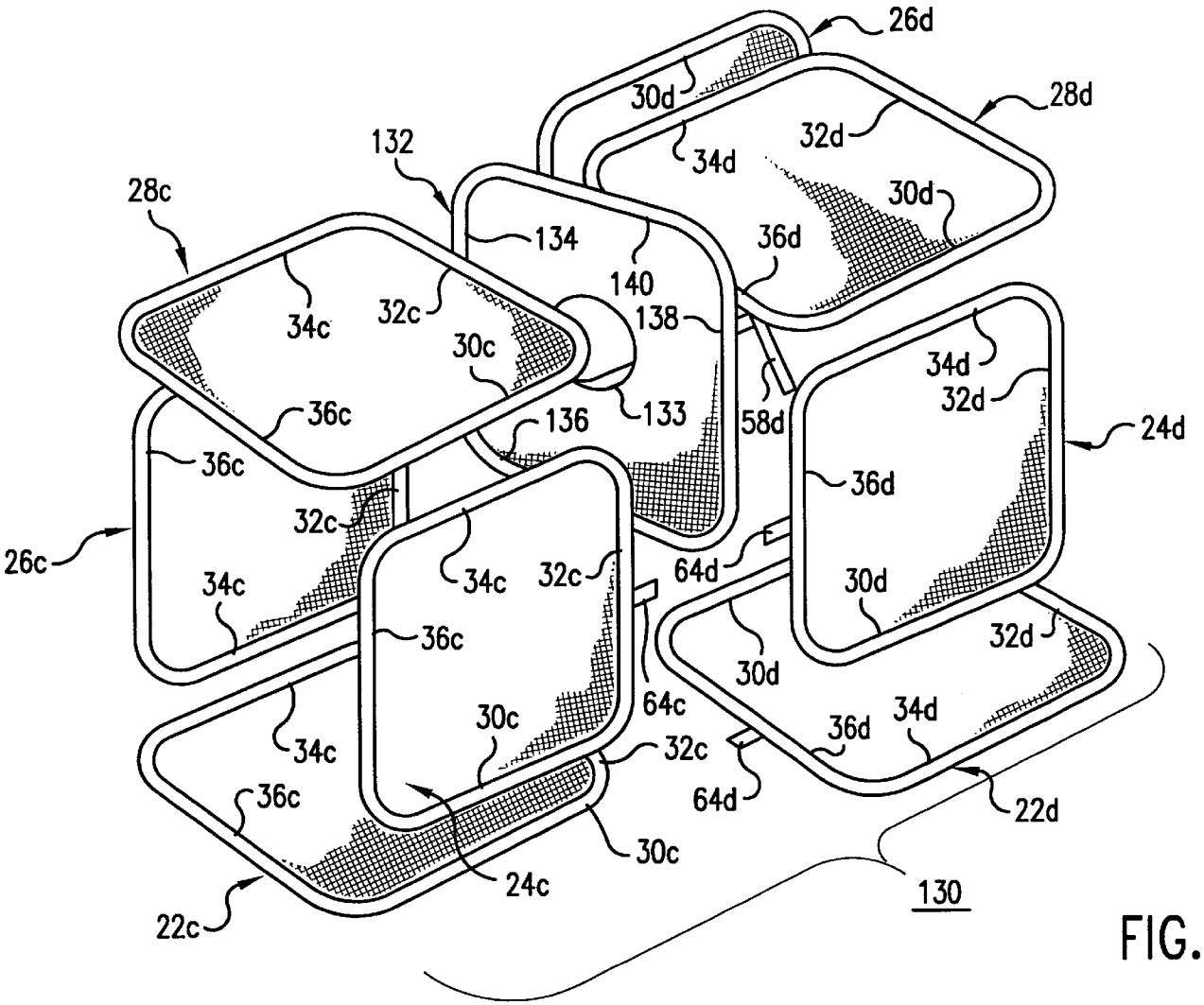
FIG. 10 is an exploded perspective view of the structure of FIG. 9.

The structure 130 in FIGS. 9 and 10 illustrate how two modules 20 can be combined to create a larger or different structure 130. The structure 130 essentially consists of two separate modules 20*c* and 20*d*, each having the same construction as module 20. The elements of the modules 20*c* and 20*d* that are the same as the elements of the module 20 are provided with the same numeral designations except that a "c" or "d" has been added to the numeral designations in FIGS. 9 and 10. The second side 32*c* of each panel 22*c*, 24*c*, 26*c*, 28*c* of module 20*c* is coupled to the fourth side 36*d* of each panel 22*d*, 24*d*, 26*d*, 28*d* in module 20*d*. This coupling can be accomplished by using either of the connections illustrated in FIGS. 2A or 2B, or by using removable attachment mechanisms 64*c* and 64*d* as illustrated in FIG. 10.

In addition, an optional support panel 132 can be provided, with its sides 134, 136, 138, 140 coupled (by either of the connections illustrated in FIGS. 2A or 2B, or by using removable attachment mechanisms) to the second side 32*c* of each panel 22*c*, 24*c*, 26*c*, 28*c* of module 20*c* and the fourth side 36*d* of each panel 22*d*, 24*d*, 26*d*, 28*d* in module 20*d*. Support panel 132 provides internal stability and support for the connection or coupling of the two modules 20*c*, 20*d*. In addition, by coupling a plurality of modules 20 together, one can create a tunnel or other passageway if the panel 132 is not provided, or if an opening 133 is provided in the panel 132 (see FIG. 10).

As an alternative to the support panel 132, any of the support mechanisms described above can be provided along the second sides 32*c* or 32*d* and fourth sides 36*c* or 36*d*. For example, as shown in FIGS. 9 and 10, these support mechanisms can take the form of the straps 58*c* or 58*d* described above.

Structure 130 can be disassembled and collapsed according to the principles set forth above in connection with FIGS. 3A–3E. If modules 20*c*, 20*d* can be detached, then each module 20*c*, 20*d* can be folded and collapsed separately, with support panel 132 placed on top of the stack of panels of either module 20*c* or 20*d* and then folded and collapsed together as a combined stack. Alternatively, the two stacks of panels 22*c*, 24*c*, 26*c*, 28*c* and 22*d*, 24*d*, 26*d*, 28*d* can be placed on top of each other (together with support panel 132), and the stack of nine panels folded and collapsed together. If the modules 20*c*, 20*d* are hingedly stitched together, then panels 24*c*, 24*d*, 28*c*, 28*d* can be folded on to panels 22*c*, 22*d*, 26*c*, 26*d*, respectively, then combined panels 28*c*, 28*d*, 26*c*, 26*d* can be folded on to combined panels 24*c*, 24*d*, 22*c*, 22*d*. Thereafter, the panels 22*d*, 24*d*, 26*d*, 28*d* of panel 20*d* are folded about the hinged connection along sides 32*c* and 36*d* to rest against the panels 22*c*, 24*c*, 26*c*, 28*c* of panel 20*c* to create a stack of eight panels that can be folded and collapsed according to FIGS. 3B–3E.

Figure 11:
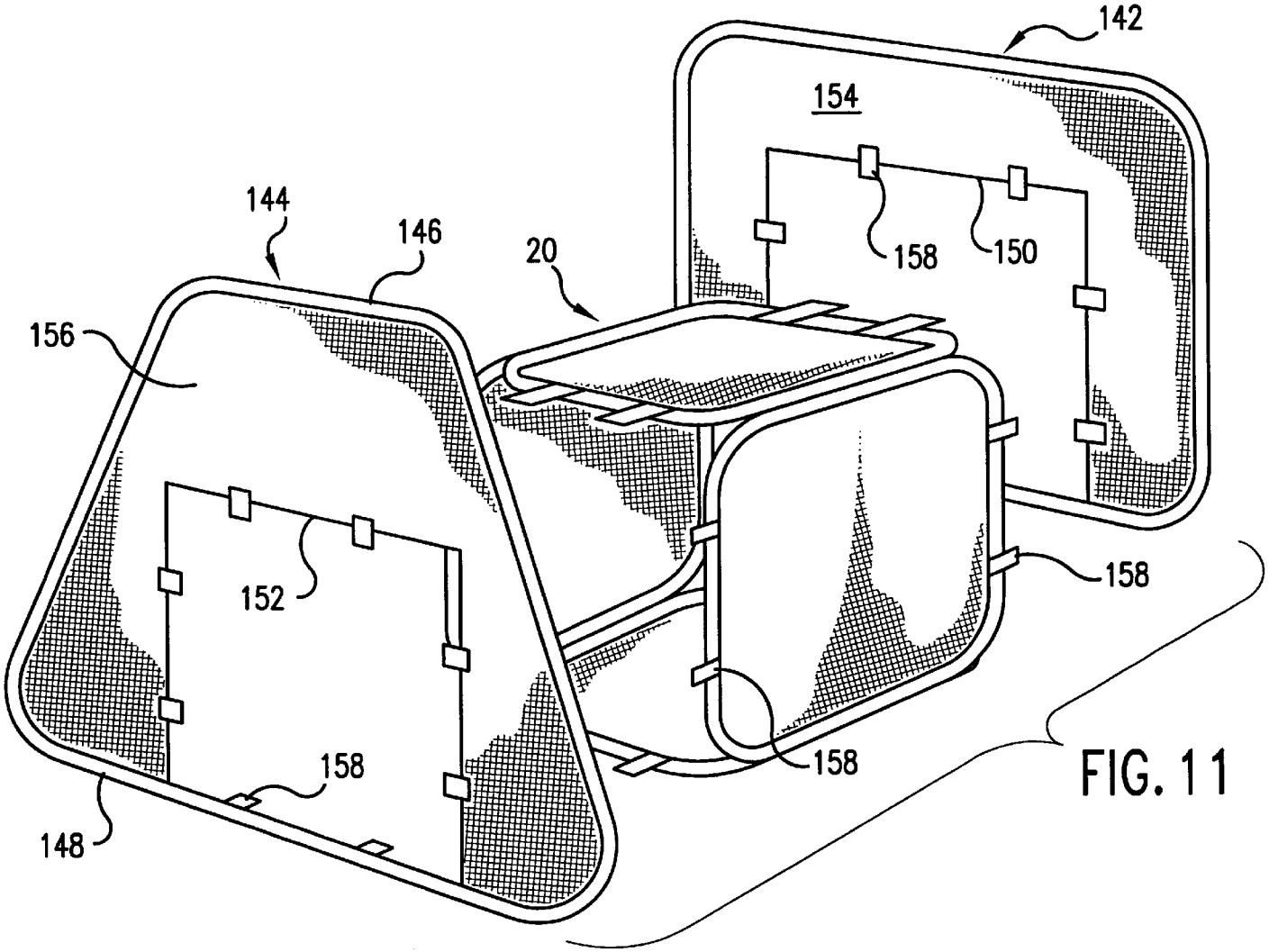
FIG. 11 is an exploded perspective view illustrating how two end panels can be deployed with the structure of FIG. 1.
Figure 12:
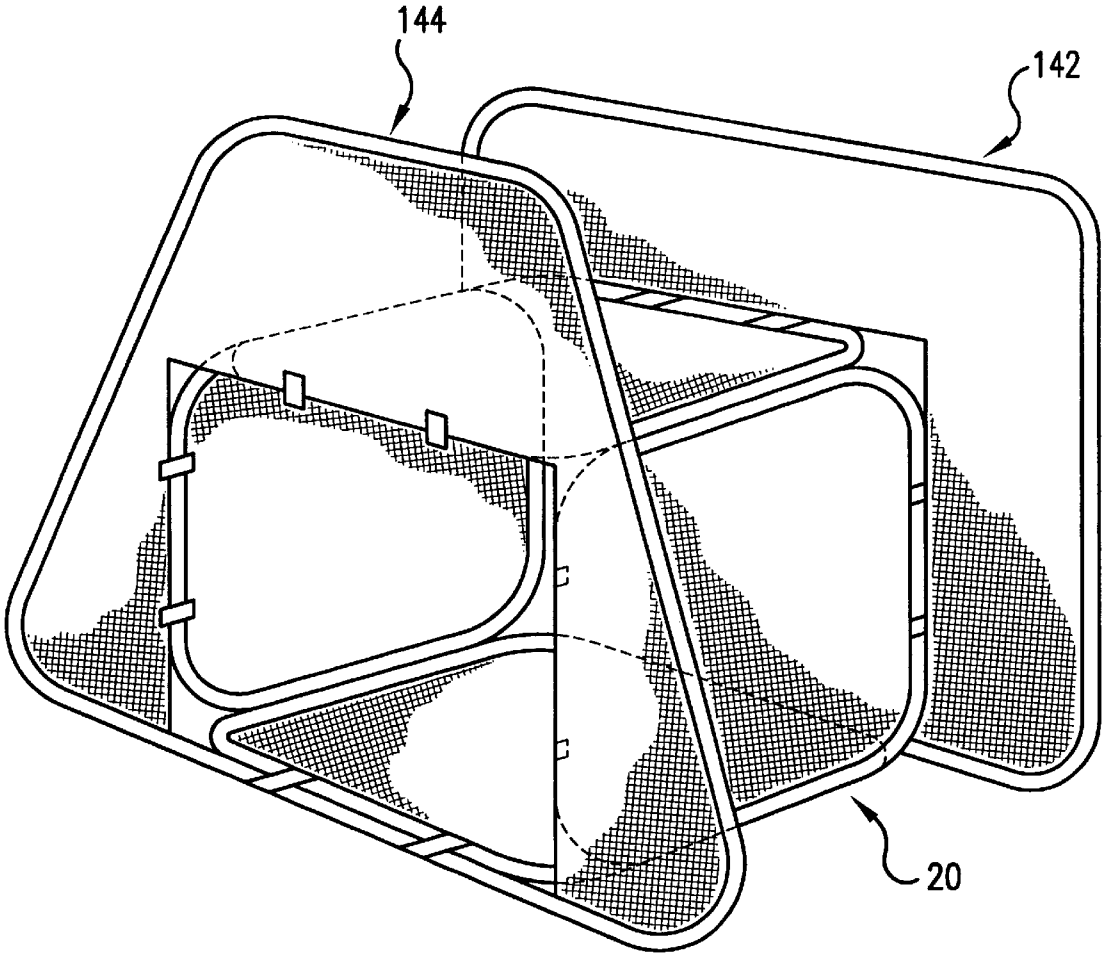
FIG. 12 is a perspective view illustrating the two end panels of FIG. 11 assembled with the structure of FIG. 1.

The first and second side openings created by the modules 20 according to the present invention can be used for many purposes. As illustrated in FIGS. 9 and 10, they can be used as openings to provide ingress to and egress from a tunnel-like structure. Another example is illustrated in FIGS. 11 and 12, where end panels 142 and 144 are provided to support the module 20 at the first and second side openings. Each end panel 142 and 144 has the same construction as any of the panels 22, 24, 26, 28, except that each end panel 142, 144 can have a different shape and size. For example, end panel 142 has a larger square or rectangular shape, while end panel 144 has a larger size and shorter top side 146 and longer bottom side 148. In addition, each end panel 142, 144 has an opening 150, 152, respectively, provided in its fabric piece 154, 156, respectively. Each opening 150, 152 is sized and configured to match the size and configuration of the first and second side openings of the module 20. Attachment mechanisms 158 can be provided along the periphery of these openings 150, 152 and/or the first and second side openings of the module 20 to couple the end panels 142, 144 to the module 20. The assembled structure is shown in FIG. 12.

Thus, the embodiments of the present invention increase the applications and utility of the collapsible structures to provide the user with an unlimited source and variety of fun and entertainment. The shapes and sizes of the panels and the structures can be varied or combined, as well as the entertainment features. These embodiments further illustrate the versatility of the basic modules 20 of the present invention, in that these basic modules 20 can be used to form the basis for numerous structures that offer an unlimited variety of entertainment and other purposes.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure adapted to be supported on a surface and comprising at least four panels, including a bottom panel, a first panel, a second panel and a third panel, each panel having a foldable frame member having a folded and an unfolded orientation, with a fabric material covering portions of the frame member to form the panel when the frame member is in the unfolded orientation, the fabric assuming the unfolded orientation of the frame member, each panel further including a first side and a second side, with the first side of one panel coupled to the second side of an adjacent panel, and with the bottom panel resting on a surface.

2. The structure of claim 1, wherein each panel further includes opposing third and fourth sides, so that the third sides of all the panels together define a first side opening for the structure, and the fourth sides of all the panels together define a second side opening for the structure.

3. The structure of claim 2, further including a side panel covering the first side opening and having a side that is coupled to one of the sides of one of the other panels of the structure.

4. The structure of claim 3, further including a second side panel covering the second side opening and having a side that is coupled to one of the sides of one of the other panels of the structure.

5. The structure of claim 3, wherein the side panel is hingedly coupled to one of the sides of one of the other panels of the structure by a detachable attachment mechanism.

6. The structure of claim 3, wherein the side panel is hingedly coupled to one of the sides of one of the other panels of the structure by stitching.

7. The structure of claim 2, further including a support mechanism coupling the third side of two adjacent panels.

8. The structure of claim 7, wherein the support mechanism is a panel.

9. The structure of claim 7, wherein the support mechanism is a strap.

10. The structure of claim 7, wherein the support mechanism is a fabric piece.

11. The structure of claim 1, wherein the fabric material extends across the entire panel of at least one of the panels.

12. The structure of claim 1, wherein the at least four panels further includes a fourth panel, a fifth panel, a sixth panel and a seventh panel.

13. The structure of claim 2, further including an end panel having an opening that has the same size and configuration as the first side opening, the end panel coupled to the third sides of each panel.

14. A collapsible structure adapted to be supported on a surface, comprising:

a first module and a second module, each module having four panels, including a bottom panel, a first panel, a second panel and a third panel, each panel having a foldable frame member having a folded and an unfolded orientation, with a fabric material covering portions of the frame member to form the panel when the frame member is in the unfolded orientation, the fabric assuming the unfolded orientation of the frame member, each panel further including a first side, a second side and a third side;

wherein the first side of each panel of each module is coupled to the second side of an adjacent panel of the same module, and the bottom panel of each module rests on a surface; and wherein the third side of each panel of the first module is coupled to the third side of a corresponding panel of the second module.

15. The structure of claim 14, further including a support panel coupled to the third sides of each panel of the first and second modules.

16. The structure of claim 14, further including a support mechanism coupling the third side of two adjacent panels.

* * * * *